United States Patent [19]

Häseler

[11] Patent Number: 4,615,971

[45] Date of Patent: Oct. 7, 1986

[54] PHOTOGRAPHIC DEVELOPER COMPOSITION

[75] Inventor: Helmut Häseler, Leverkusen, Fed. Rep. of Germany

[73] Assignee: Agfa-Gevaert Aktiengesellschaft, Leverkusen, Fed. Rep. of Germany

[21] Appl. No.: 774,806

[22] Filed: Sep. 10, 1985

Related U.S. Application Data

[63] Continuation of Ser. No. 581,877, Feb. 21, 1984, abandoned.

[30] Foreign Application Priority Data

Mar. 3, 1983 [DE] Fed. Rep. of Germany ..... 3307507

[51] Int. Cl.[4] ..... G03C 5/30; G03C 7/30

[52] U.S. Cl. ..... 430/491; 430/467; 430/490

[58] Field of Search ..... 430/488, 491, 490, 467

[56] References Cited

U.S. PATENT DOCUMENTS

| | | | |
|---|---|---|---|
| 3,746,544 | 7/1973 | Heilmann | 430/491 |
| 3,785,824 | 1/1974 | Fisch | 430/466 |
| 4,374,733 | 2/1983 | Snyder et al. | 210/701 |

OTHER PUBLICATIONS

Research Disclosure, May 1983, p. 179, Abst. No. 22937.

*Primary Examiner*—Mary F. Downey
*Attorney, Agent, or Firm*—Connolly and Hutz

[57] ABSTRACT

Developer compositions which contain a hydrolyzed polymaleic acid anhydride having improved protection against precipitation of calcium compounds.

6 Claims, No Drawings

PHOTOGRAPHIC DEVELOPER COMPOSITION

CROSS REFERENCE

This application is a continuation of application Ser. No. 581,877 filed Feb. 21, 1984 by Helmut Haseler for "Photographic Developer Composition" (now abandoned).

This invention relates to a photographic developer composition for the preparation of photographic images having improved protection against precipitation of calcium compounds.

Photographic developers normally have certain compounds added to them in addition to the developer substances proper in order to improve the properties of the developer mixture, e.g. so-called sequestering agents or water softeners, in particular to prevent the precipitation of calcium compounds. Compounds which enhance the resistance of the developer composition to oxidation, e.g. hydroxylamine, are also conventionally used.

Polyphosphates and carboxylic acids containing amino groups are examples of known sequestering agents. The effectiveness of these compounds depends to a large extent on the composition of the developer. In the case of photographic colour developers containing a p-phenylene-diamine as developer substance and hydroxylamine to improve the resistance to oxidation, there is the added difficulty that many of the compounds used as sequestering agents cause decomposition of hydroxylamine.

Known sequestering agents include, for example, the organic phosphonic acids disclosed in DE-OS No. 2 306 472, but these no longer satisfy the more stringent present day requirements. According to DE-OS Nos. 2 707 989 and U.S. Pat. No. 4,083,723, organic compounds containing at least one phosphonic group and at least one carboxyl group in the molecule are capable of forming complexes with heavy metal and calcium ions. Such compounds, however, are liable to pollute the effluent by their phosphorus content.

Aminopolycarboxylic acids, which have been disclosed, for example, in U.S. Pat. No. 3,462,269, are liable to alter the activity of a colour developer to such an extent as to cause changes which are difficult to foresee in the development of the individual layers of a recording material. The usefulness of these compounds is further limited by the fact that they reduce the stability of colour photographic developers. This is presumably due to an accelerated decomposition of the compounds added for improving the resistance to oxidation, such as hydroxylamine. Furthermore, when aminopolycarboxylic acids are used in less than stoichiometric quantities based on the calcium ions, relatively hard precipitates are formed which interfere very seriously with the development of photographic recording materials.

Aminopolyphosphonic acids, which have been disclosed, for example, in U.S. Pat. No. 3,201,246, also alter the activity of a colour developer.

It is known from DE-AS No. 2 159 172 and U.S. Pat. No. 3,810,834 that the deposition of hard water scale on heat transfer surfaces can be reduced by means of hydrolysed polymaleic acid anhydride. According to DE-OS No. 2 259 954 and GB-PS No. 1 374 276, corrosion and formation of scale is inhibited by the combined used of zinc ions and hydrolysed polymaleic acid anhydride.

The last documents mentioned, however, make absolutely no reference to any photographic applications.

According to Research Disclosure No. 17,442, 1978, page 31, the deposition of crystals of developer compounds when water evaporates from the developer bath may be prevented by various polymers. Among those mentioned are cellulose derivatives and copolymers of vinyl ethers, e.g. with maleic acid anhydride. There is no mention, however, of such copolymers providing any protection against precipitation of calcium compounds. Rather may it be assumed that no such protection is obtained since it is explicity stated on page 31, at the bottom of the righthand column, that additional water-softening agents may be present.

According to U.S. Pat. No. 3,785,824, copolymers of maleic acid anhydride may be used as dispersing agents for difficulty soluble developer components. There is no indication in U.S. Pat. No. 3,785,824 that these copolymers provide any calcium sequestering action, and in fact a completely different compound is used as a "sequestering agent" in Example 1 (column 4, line 29).

It is an object of the present invention to provide improved protection against precipitates, especially of calcium compounds, in photographic developer compositions. In particular, the protection against precipitates, especially of calcium compounds of water-softening should not affect the sensitometric properties. Furthermore, it should in particular not impair the stability of any antioxidizing agent added.

A developer composition for the development of recording materials containing silver halide has now been found which contains at least one complex former for binding unwanted metal ions. According to the invention, the developer composition contains hydrolysed polymaleic acid anhydride as a complex former.

As mentioned above, hydrolysed polymaleic acid anhydride is known per se. It may be prepared by the hydrolysis of polymerized maleic acid anhydride, e.g. by heating with water. The polymaleic acid anhydride used as starting material may be prepared, for example, according to GB-PS No. 1 024 725. The product obtained from hydrolysis of polymaleic acid anhydride contains numerous carboxylic acid groups and possibly a small number of residual anhydride groups and is normally referred to according to DE-AS No. 2 159 172 as hydrolysed polymaleic acid anhydride. It is assumed that a certain decarboxylation of the polymer may occur during polymerisation of during subsequent hydrolysis so that the acid value of the hydrolysed polymaleic acid anhydride may be lower than the theoretical value.

Hydrolysed polymaleic acid anhydride, which is particularly suitable for the present invention, may be obtained according to Example 1 of DE-AS No. 2 159 172 and U.S. Pat. No. 3,810,834.

A particularly suitable hydrolysed polymaleic acid anhydride has an average molecular weight of from 800 to 1000. It is soluble in water in all proportions, has a viscosity at 22° C. of from 50 to 100 cP, a boiling point of from 100° C. to 101° C. and a freezing point of from −5° C. to −12° C.

According to the invention, the hydrolysed polymaleic acid anhydride may be used in any quantity in a photographic developer. The quantity used is generally from 0.01 to 50 g, preferably from 0.05 to 20 g, in particular from 0.5 to 2.5 g per liter of colour developer.

It is surprisingly found that colour developers which contain hydrolysed polymaleic acid anhydride according to the invention as water softeners have the following advantages:

1. Resistance to hydrolysis in the alkaline region.
2. Prevention of formation of hard crystalline precipitates of calcium compounds even when used in less than stoichiometric proportions to calcium (so-called dispersion effect).
3. Avoidance of precipitation of sparingly soluble calcium compounds in the presence of sodium ions.
4. No impairment in developer activity.
5. No acceleration of decomposition of any hydroxylamine added.

The developer compositions according to this invention are primarily colour developers. They preferably contain p-phenylenediamine derivatives as the colour developer substances, e.g.: N,N-dimethyl-p-phenylenediamine, 4-amino-3-methyl-N-ethyl-N-methoxyethylaniline, 2-amino-5-diethylaminotoluene, N-butyl-N-ω-sulphobutyl-p-phenylenediamine, 2-amino-5-(N-ethyl-N-β-methanesulphonamidoethylamino)-toluene, N-ethyl-N-β-hydroxyethyl-p-phenylenediamine, N,N-bis-β-hydroxyethyl)-p-phenylenediamine, 2-amino-5-(N-ethyl-N-β-hydroxyethylamino)-toluene.

Other suitable colour developers have been described, for example, in J. Amer.Chem.Soc. 73, 3100 (1951).

The hydrolysed polymaleic acid anhydride may, of course, also be used in black-and-white developers containing, for example, dihydroxybenzenes, 3-pyrazolidones, aminophenols, 1-phenyl-3-hydrazolines, ascorbic acid or other commonly used developer substances.

In particular, the developer composition according to the invention may in addition contain compounds protecting against oxidation, e.g. hydroxylamine, ascorbic acid, certain sugars and glucosamine.

Other complex formers may be used in addition to hydrolysed polymaleic acid anhydride, e.g. organic phosphonic acids, phosphonocarboxylic acids, aminopolycarboxylic acids and aminopolyphosphonic acids.

The usual buffers, development accelerators, antifogging agents, competing couplers, surface active agents and white toners may also be added to the developer compositions according to the invention. Reference may be made in this connection to Ullmanns Enzyklopä die der technischen Chemie, 4th Edition, Volume 18, 1979, in particular pages 451, 452 and 463 to 465. A detailed description of suitable developer compositions and processing methods for which the hydrolysed polymaleic acid anhydride according to the invention is suitable has been given by Grant Haist, in Modern Photographic Processing, John Wiley and Sons, 1973, Volumes 1 and 2.

The developer compositions according to the invention are thus suitable both for negative and for reversal processing. They are particularly suitable for rapid processing at elevated temperatures and may also be used in developers intended for intensification processes. An intensification process may, for example, make use of the decomposition of hydrogen peroxide in the presence of metal nuclei. The developer compositions according to this invention are suitable for the processing of conventional photographic recording materials. If colour photographic materials are to be used, the couplers required for producing a colour image may be present in the recording material or they may be present in the developer composition.

Recording materials containing non-diffusible colour couplers are particularly advantageous. In such materials, each red-sensitive silver halide emulsion layer is generally associated with at least one non-diffusible colour coupler for producing the cyan partial colour image, generally a coupler of the phenol or α-naphthol series. Each of the green-sensitive silver halide emulsion layers is generally associated with at least one non-diffusible colour coupler for producing the magenta partial colour image, generally colour couplers of the 5-pyrazolone or the indazolone series. Each blue-sensitive silver halide emulsion layer is generally associated with at least one non-diffusible colour coupler for producing the yellow partial colour image, generally a colour coupler having an open chain β-diketomethylene or β-diketomethine group.

By way of example, reference may be made to the publications: "Farbkuppler" by W. Pelz in "Mitteilungen aus den Forschungslaboratorien der Agfa, Leverkusen/Muchen" Volume III, page 111 (1961), K. Venkataraman in "The Chemistry of Synthetic Dyes", Vol. 4, 341 to 387, Academic Press (1971), and T. H. James, "The Theory of the Photographic Process", 4th Edition, pages 353–362.

Colour couplers may be conventional 4-equivalent couplers or they may be 2-equivalent couplers. Also to be included among the 2-equivalent couplers are the known white couplers, which do not rise to a dye in their reaction with colour developer oxidation products, and the DIR couplers, which contain, in the coupling position, a removable group which may be released as a diffusible development inhibitor.

Other suitable additives for photographic recording materials are given in the periodical "Product Licensing Index", Volume 92, December 1971, pages 107 to 110, and in Research Disclosure No. 22534 of January 1983.

Halides in the silver halide emulsions used in the materials may be chloride, bromide, iodide or mixtures thereof. It is preferred to use bromide and iodobromide emulsions, which may be ripened and optically sensitized in the usual manner (see in particular Ullmanns Enzyklopädie der technischen Chemie, 4th Edition, Volume 18, pages 424 et seq and 431 et seq). The recording materials may be stabilized. Azaindenes are particularly suitable stabilizers, especially the tetra- and penta-azaindenes and particularly those which are substituted with hydroxyl or amino groups. Compounds of this type have been described, for example, in the article by Birr. Z.Wiss.Phot. 47 (1952), 2–58. Other suitable stabilizers include heterocyclic mercapto compounds, e.g. phenylmercapto-tetrazole, quaternary benzothiazole derivatives, benzotriazole, etc.

EXAMPLE 1

This example demonstrates the prevention of hard crystalline deposits of calcium compounds when the complex formers according to the invention are used in the sub-stoichiometric region.

The following developer (a) is prepared by addition of the compounds given below in the sequence given:

| | |
|---|---|
| Water | 900 ml |
| Nitrilotriacetic acid, trisodium salt | 0.65 g |
| Benzyl alcohol | 14 ml |
| Hydroxylammonium sulphate | 3 g |

-continued

| | |
|---|---|
| Calcium chloride solution, 10% | 20 ml |
| 4-Amino-N—ethyl-N—(β-methane sulphonamido)-m-toluidine sesqui-sulphate (monohydrate) | 4 g |
| Sodium sulphite, sicc. | 1 g |
| Potassium bromide | 0.5 g |
| Potassium carbonate solution, 40% made up with water to 1 liter. | 55 ml |

The following developers are prepared for comparison:

Developer (b): This contains 1 g of diethylenetriaminopentaacetic acid instead of the trisodium salt of nitrilotriacetic acid.

Developer (c): This is a developer composition according to the invention containing hydrolysed polymaleic acid anhydride in a quantity of 1.5 ml of a 50% aqueous solution instead of the nitrilotriacetic acid.

After the developers had been left to stand for 24 hours at 20° C., the following visual finding is obtained:

Developer (a): The calcium in the developer is precipitated in a hard crystalline form lying as a compact deposit at the bottom of the vessel.

Developer (b): Result the same as for (a).

Developer (c) according to the invention: The precipitated calcium compounds are present in a bulky, flocculent form and do not form hard deposits at the bottom of the vessel.

It follows that when developers (a) and (b) are used, the recording material is liable to be damaged by the hard crystalline deposition of calcium compounds, which is avoided in developer (c), where the calcium is deposited in a flocculent, bulky form.

EXAMPLE 2

Developers which contain sodium ions in addition to calcium ions present a special problem and are liable to form particularly troublesome precipitates.

A developer (a) is first prepared by addition of the following individual constituents in the sequence given:

| | |
|---|---|
| Water | 900 ml |
| 1-Hydroxyethane-1,1-diphosphonic acid, 61% | 2 ml |
| Benzyl alcohol | 14 ml |
| Hydroxylammonium sulphate | 3 g |
| Calcium chloride solution, 10% | 3.5 ml |
| 4-Amino-N—ethyl-N—(β-methanesulphonamido)-m-toluidine sesquisulphate (monohydrate) | 4 g |
| Sodium sulphite, sicc. | 1 g |
| Potassium bromide | 0.5 g |
| Sodium carbonate made up with water to 1 liter. | 30 g |

Developer (b) according to the invention is prepared, which instead of 1-hydroxyethane-1,1-diphosphonic acid contains hydrolyzed polymaleic acid anhydride according to the invention in a quantity of 2 ml of a 50% aqueous solution.

After 2 days, a white deposit of precipitated calcium and sodium ions forms in developer (a), making the developer unusable. Developer composition (b) according to the invention remains clear and without any precipitate.

EXAMPLE 3

This example shows that hydrolysed polymaleic acid anhydride used according to the invention does not have the deleterious effect on the results of sensitometric development found when other complex formers are used.

The commercial light-sensitive colour photographic recording material used contains a blue-sensitive yellow layer on a polyethylene coated support, a green-sensitive magenta layer and a red-sensitive cyan layer. This material is in each case exposed in the same manner and subjected to the following processing:

| Processing steps | Temperature (°C.) | Time |
|---|---|---|
| Colour development | 33 | 3.5 min |
| Stopping | 33 | 1 min |
| Bleach fixing | 33 | 2 min |
| Washing | 33 | 3 min |

The following developer compositions are prepared for developing the individual samples:

| | |
|---|---|
| Developer 1 without complex former | |
| Water | 900 ml |
| Benzyl alcohol | 14 ml |
| Hydroxylammonium sulphate | 3 g |
| 4-Amino-N—ethyl-N—(β-methane sulphonamido)-m-toluidine sesquisulphate (monohydrate) | 5 g |
| Sodium sulphite, sicc. | 1 g |
| Potassium bromide | 0.6 g |
| Potassium carbonate solution, 40% made up with water to 1 liter. | 55 ml |
| pH: 10.2 | |
| Developer 2 according to the invention | |
| Water | 900 ml |
| Hydrolysed polymaleic acid anhydride, 50% | 3 ml |
| Benzyl alcohol | 14 ml |
| Hydroxylammonium sulphate | 3 g |
| 4-Amino-N—ethyl-N—(β-methane-sulphonamido)-m-toluidine sesquisulphate (monohydrate) | 5 g |
| Sodium sulphite, sicc. | 1 g |
| Potassium bromide | 0.6 g |
| Potassium carbonate solution, 40% | 55 ml |
| pH - correct to 10.2 with NaOH (as in developer 1) made up with water to 1 liter. | |
| Developer 3 | |
| This developer contains 1.5 g of diethylene triaminopentaacetic acid instead of hydrolysed polymaleic acid anhydride. | |
| pH - Correct to 10.2 with NaOH (as in developer 1). | |
| Developer 4 | |
| This developer contains 3 ml of 40% pentasodium-aminotrimethylphosphonate solution instead of hydrolysed polymaleic acid anhydride. | |
| pH 10.2 (as in developer 1). | |
| Developer 5 | |
| This developer contains 1.5 g of the trisodium salt of nitrilotriacetic acid instead of hydrolysed polymaleic acid anhydride. | |
| pH 10.2 (as in developer 1). | |

The short stop bath used contained 2% acetic acid while the bleach fix bath had the following composition:

| Bleach fix bath | |
|---|---|
| Water | 800 ml |
| Sodium sulphite sicc. | 20 g |
| Ammonium thiosulphate | 100 g |
| Sodium-iron-III-ethylene diaminotetracetic acid | 45 g |
| Potassium carbonate | 9 g |
| pH 7 | |

The optical reflection densities of the materials processed as indicated above were measured with a densitometer through red, green and blue filters. The results are entered in the Table below. The densities indicated for "Measuring field 1" and "Measuring field 2" are in each case obtained at the same intensity of exposure. The difference between the densities thus obtained is defined as the "relative contrast". The results obtained with developer 1 are taken as the standard since this developer does not contain any complex forming agents. The percentage deviations from this standard when the various complex forming agents are used are entered in percent in the columns headed with Δ.

| | Developer | | | | | | | | |
|---|---|---|---|---|---|---|---|---|---|
| | 1 | 2 | | 3 | | 4 | | 5 | |
| | D | D | Δ | D | Δ | D | Δ | D | Δ |
| Reflection density Cyan (Red filter measurement) | | | | | | | | | |
| Measuring field 1 | 1.13 | 1.13 | 0 | 1.33 | 17.7 | 1.24 | 9.7 | 1.17 | 3.5 |
| Measuring field 2 | 0.66 | 0.65 | −1.5 | 0.79 | 19.6 | 0.68 | 3.0 | 0.64 | −3.0 |
| relative contrast | 0.47 | 0.48 | 2.1 | 0.54 | 14.9 | 0.56 | 19.0 | 0.53 | 12.7 |
| Reflection density Magenta (Green filter measurement) | | | | | | | | | |
| Measuring field 1 | 1.14 | 1.14 | 0 | 1.24 | 8.7 | 1.23 | 7.9 | 1.19 | 3.5 |
| Measuring field 2 | 0.67 | 0.67 | 0 | 0.69 | 2.9 | 0.70 | 4.4 | 0.66 | −1.5 |
| relative contrast | 0.47 | 0.47 | 0 | 0.55 | 17.0 | 0.53 | 12.7 | 0.53 | 12.7 |
| Reflection density Yellow (Blue filter measurement) | | | | | | | | | |
| Measuring field 1 | 1.33 | 1.36 | 2.2 | 1.38 | 3.7 | 1.33 | 0 | 1.32 | −0.7 |
| Measuring field 2 | 0.74 | 0.75 | 1.3 | 0.76 | 2.7 | 0.75 | 1.3 | 0.70 | −5.4 |
| relative contrast | 0.59 | 0.61 | 3.3 | 0.62 | 5.0 | 0.58 | −1.7 | 0.62 | 5.0 |

Developers 3, 4 and 5 show considerable senstiometric deviations from the values obtained with developer 1 which is free from complex formers. Developer 2 containing the complex former according to the invention alone shows no or only negligible sensitometric deviations.

EXAMPLE 4

The stability of hydroxylamine in photographic developers containing various complex formers is investigated in this example. The following developers are prepared for this purpose:

| Developer 1 without complex former | |
|---|---|
| Water | 800 ml |
| Benzyl alcohol | 14 ml |
| Hydroxylammonium sulphate | 2.6 g |
| 4-Amino-N—ethyl-N—(β-methane-sulphonamido)-m-toluidine sesquisulphate (monohydrate) | 4 g |
| Sodium sulphite, sicc. | 1 g |
| Potassium bromide | 0.6 g |
| Potassium carbonate solution, 40% | 55 ml |

-continued

| Developer 1 without complex former |
|---|
| made up with water to 1 liter. |

Developer 2

1.5 g of the tetrasodium salt of ethylenediaminotetracetic acid are dissolved in the water provided. The substances listed under developer 1 are then added in the sequence given.

Developer 3

1.5 g of the trisodium salt of nitrilotriacetic acid are used as the complex former instead of ethylenediaminotetracetic acid. The various substances are dissolved in the same sequence as that used for developer 2.

Developer 4

This developer is prepared by the method described for developer 2 but 4 ml of a 40% solution of pentasodium amino-trimethylphosphonate are used as the complex former.

Developer 5

Hydrolysed polymaleic acid anhydride is used as the complex former according to the invention in a quantity of 3 ml of a 50% solution instead of ethylenediaminotetracetic acid. The other components are then dissolved as for developer 2.

The hydroxylammonium sulphate content per liter was 2.6 g in developers 1 to 5 immediately after preparation of the solutions.

After the developers had been left to stand for 4 days at 50° C., they were found to have the following residual contents of hydroxylammonium sulphate:

| Developer | Complex former | Residual hydroxyl ammonium sulphate content/l |
|---|---|---|
| 1 | none | 2.35 g |
| 2 | Ethylenediaminotetracetic acid $Na_4$ salt | 0.27 g |
| 3 | Nitrilotriacetic acid $Na_3$ salt | 0.64 g |

-continued

| Developer | Complex former | Residual hydroxyl ammonium sulphate content/l |
|---|---|---|
| 4 | Pentasodium-amino-trimethyl phosphonic acid | 0.86 g |
| 5 | Hydrolysed polymaleic acid anhydride, 50% | 2.40 g |

Assessment:

Developer 1 without complex former is unusable on account of the precipitation of calcium compounds in spite of the high stability of hydroxylamine therein.

Developer 5 according to the invention, containing the hydrolysed polymaleic acid anhydride as complex former, has virtually no deleterious effect on the stability of hydroxylamine.

I claim:

1. A developer composition for the development of silver halide-containing recording materials comprising a silver halide developing agent and at least one complex former for binding metal ions, comprising a hydrolysed polymaleic acid anhydride with an average molecular weight of from 800 to 1000 and in that said anhydride is present in an amount of at least 0.5 g per liter.

2. A developer composition according to claim 1, characterised in that the hydrolysed polymaleic acid anhydride is contained in it in a quantity of from 0.5 to 2.5 g/l of developer.

3. A developer composition according to claim 1, characterised in that the developer substance contained in it is a p-phenylenediamine.

4. A developer composition according to claim 1, characterised in that it contains an antioxidizing agent.

5. A developer composition according to claim 4, characterised in that the antioxidizng agent contained in it is hydroxylamine.

6. A developer composition according to claim 1, characterized in that the hydrolyzed polymaleic acid anhydride is the only complex former for binding metal ions.

* * * * *